US005833837A

United States Patent [19]

Miller

[11] Patent Number: 5,833,837

[45] Date of Patent: Nov. 10, 1998

[54] PROCESS FOR DEWAXING HEAVY AND LIGHT FRACTIONS OF LUBE BASE OIL WITH ZEOLITE AND SAPO CONTAINING CATALYSTS

[75] Inventor: Stephen J. Miller, San Francisco, Calif.

[73] Assignee: Chevron U.S.A. Inc., San Francisco, Calif.

[21] Appl. No.: 536,229

[22] Filed: Sep. 29, 1995

[51] Int. Cl.[6] ..... C10G 51/06

[52] U.S. Cl. ..... 208/80; 208/78; 208/27; 208/111; 208/120; 208/114

[58] Field of Search ..... 208/27, 78, 111, 208/120, 114

[56] References Cited

U.S. PATENT DOCUMENTS

| | | | |
|---|---|---|---|
| 3,894,938 | 7/1975 | Gorring et al. | 208/97 |
| 4,176,050 | 11/1979 | Chen et al. | 208/111 |
| 4,181,598 | 1/1980 | Gillespie et al. | 208/58 |
| 4,222,855 | 9/1980 | Pelrine et al. | 208/120 |
| 4,229,282 | 10/1980 | Peters et al. | 208/111 |
| 4,247,388 | 1/1981 | Banta et al. | 208/111 |
| 4,440,871 | 4/1984 | Lok et al. | 502/214 |
| 4,605,488 | 8/1986 | Chester et al. | 208/78 |
| 4,810,357 | 3/1989 | Chester | 208/27 |
| 4,859,311 | 8/1989 | Miller | 208/89 |
| 4,921,594 | 5/1990 | Miller | 208/58 |
| 4,943,424 | 7/1990 | Miller | 423/328 |
| 5,135,638 | 8/1992 | Miller | 208/27 |
| 5,149,421 | 9/1992 | Miller | 208/114 |
| 5,246,566 | 9/1993 | Miller | 208/27 |
| 5,413,695 | 5/1995 | Miller | 208/28 |
| 5,453,176 | 9/1995 | Narloch et al. | 208/27 |

FOREIGN PATENT DOCUMENTS

| | | |
|---|---|---|
| 0 161 833 A2 | 11/1985 | European Pat. Off. . |
| 0 237 655 A1 | 9/1987 | European Pat. Off. . |
| WO 92/01657 | 7/1991 | WIPO . |
| WO 91/13132 | 9/1991 | WIPO . |

OTHER PUBLICATIONS

Smith et al., "New Process Dewaxes Lube Base Stocks", Oil & Gas J., May 26, 1980, p. 75.

*Primary Examiner*—Helane Myers
*Attorney, Agent, or Firm*—Alan W. Klaassen

[57] ABSTRACT

An integrated process is provided for preparing a dewaxed heavy lube base oil product and a dewaxed light lube base oil product from a waxy feedstock. The process includes separating the waxy feedstock into two or more fractions. A light fraction is upgraded to increase its VI, and dewaxed in an isomerization process using a wax isomerization catalyst such as SAPO-11, SAPO-31 or SAPO-41. A heavy fraction is upgraded to increase its VI, and dewaxed in the presence of a wax cracking catalyst such as ZSM-5.

22 Claims, 1 Drawing Sheet

PROCESS FOR DEWAXING HEAVY AND LIGHT FRACTIONS OF LUBE BASE OIL WITH ZEOLITE AND SAPO CONTAINING CATALYSTS

FIELD OF THE INVENTION

The present invention relates to the general field of catalytic dewaxing of a lubricating oil base stock. More specifically the invention relates to an integrated process in which an intermediate pore size silicoaluminophosphate molecular sieve is used to dewax a light base oil feed stock and an intermediate pore size zeolite is used to dewax a heavy base oil feed stock.

BACKGROUND OF THE INVENTION

High quality lubricating oils are critical for the operation of modern machinery and automobiles. Unfortunately, the supply of natural crude oils having good lubricating properties is not adequate for present demands. Due to uncertainties in world crude supplies, high-quality lubricating oils often must be produced from waxy feeds. Therefore, in order to meet the demand for lubricating oil base stocks it has become necessary to upgrade crude oil fractions otherwise unsuitable for lubricant manufacture into feed stocks from which good yields of lube base oils can be obtained. Numerous processes have been proposed for producing lubricating base oils by upgrading ordinary and low quality feed stocks.

Petroleum feed stocks that are intended for use as lube oil base stocks may be upgraded either by hydrocracking or by solvent refining. This upgrading step is frequently followed by catalytic dewaxing. Catalytic dewaxing is intended to improve the lubricating oil properties of the base stock by lowering the pour point and the cloud point by selectively cracking or by isomerizing the waxes that are present while maintaining the viscosity.Intermediate pore size aluminosilicate zeolites such as ZSM-5, ZSM-11, ZSM-12, ZSM-23, ZSM-35, and ZSM-38 have been proposed for use in catalytic dewaxing processes and are described in U.S. Pat. Nos. 3,894,938; 4,176,050; 4,181,598; 4,222,855; 4,229,282; and 4,247,388. ZSM-5 and ZSM-11 are taught in U.S. Pat. No. 4,605,488 to be particularly useful in cracking the waxes in heavy charge stocks to produce lower molecular weight products.

Intermediate pore size silicoaluminophosphate molecular sieves, referred to as intermediate pore SAPO's, have also been taught as being useful in the isomerization of the waxes present in lube oil base stocks. See U.S. Pat. Nos. 4,921,594 and 5,135,638. Intermediate pore SAPO's useful in the isomerization of the waxes in the base stocks are described generally in U.S. Pat. Nos. 4,440,871 and 5,246,566. U.S. Pat. No. 4,943,424 describes the silicoaluminophosphate molecular sieve, SM-3, an intermediate pore SAPO that has been found to be particularly useful in isomerizing the waxes in lube base oils. Since intermediate pore SAPO's isomerize the waxes in the base stocks rather than cracking them, intermediate pore SAPO's generally will produce higher yields with lighter feed stocks as compared to solvent dewaxing and catalytic dewaxing with a zeolite. Alternatively, intermediate pore SAPO's generally will produce higher VI products with lighter feedstocks as compared to solvent dewaxing and catalytic dewaxing with a zeolite. See Smith et al., Oil & Gas J., May 26, 1980, page 75, and U.S. Pat. No. 4,859,311. Thus, intermediate pore SAPO's offer important advantages over aluminosilicate zeolites in upgrading certain low quality lube base stocks. However, Applicant has found that intermediate pore SAPO's are more sensitive to nitrogen and sulfur levels in the feed than are aluminosilicate zeolites. The sensitivity of intermediate pore SAPO's to nitrogen and sulfur especially becomes a problem with heavier feed stocks which typically will contain higher levels of these impurities than lighter feed stocks. Heavier feed stocks prepared using solvent refining processes have been found to be especially difficult for intermediate pore SAPO's to handle, since such heavy base stocks typically contain relatively high levels of nitrogen and sulfur.

In conventional catalytic dewaxing, as represented by dewaxing over an intermediate pore aluminosilicate such as ZSM-5, the waxes present in the feedstock are cracked to lower molecular weight materials. For light feeds, the yield loss due to this cracking is greater than the wax content removed from the feed, as determined by solvent dewaxing. With heavier feeds, the yield loss is near that for solvent dewaxing. Wax isomerization catalysts, represented by intermediate pore SAPO's, which may contain an hydrogenation metal, generally show a yield loss due to cracking which is less than the wax content of the feed, particularly for light feedstocks. However, the yield advantage of wax isomerization catalysts compared to catalysts which crack the wax diminishes as the feed gets heavier, in part due to the improved yield for the latter with heavier feeds. Further, the higher activity of the selective wax cracking catalyst enables it to more easily handle the more difficult heavy feed.

The separate treatment of light and heavy feed stocks by different aluminosilicate zeolites in order to take advantage of the different catalytic activities has been proposed in U.S. Pat. No. 4,605,488. U.S. Pat. No. 5,149,421 teaches the use of a layered catalyst system employing an intermediate pore size SAPO and an intermediate pore size aluminosilicate zeolite to dewax a waxy feed stock. However, hitherto the use of an isomerization catalyst, such as an intermediate pore SAPO, and a conventional dewaxing catalyst, such as an intermediate pore aluminosilicate zeolite, to separately treat different components of a waxy feedstock has not been suggested. U.S. Pat. No. 5,413,695 teaches the use of an intermediate pore SAPO to dewax the raffinate from a solvent refining process. The present invention is directed to an improved process for upgrading lube oil base stocks by using catalysts containing an intermediate pore SAPO and an aluminosilicate zeolite, respectively, to separately treat lube base oil feed stocks in a more efficient and advantageous manner than has been possible previously.

SUMMARY OF THE INVENTION

In its broadest aspect the present invention is directed to an integrated process for improving the lubricating oil properties of a waxy feed stock, the process comprising;

a. separating the waxy feedstock into at least a light fraction and a heavy fraction;

b. upgrading at least a portion of the heavy fraction to form a waxy heavy lube base oil having a viscosity index which is greater than that of the heavy fraction;

c. upgrading at least a portion of the light fraction to form a waxy light lube base oil having a viscosity index which is greater than that of the light fraction;

d. cracking at least a portion of the waxes present in the waxy heavy lube base oil in a first dewaxing zone in the presence of a wax cracking catalyst under process conditions preselected to crack said waxes;

e. isomerizing at least a portion of the waxes present in the waxy light lube base oil in a second dewaxing zone in the presence of a wax isomerizing catalyst under process conditions preselected to isomerize said waxes; and f. recovering a catalytically dewaxed heavy lube base oil product and a catalytically dewaxed light lube base oil product from the first and second dewaxing zones, respectively, each of said products having improved lubricating oil properties.

More specifically the present invention is directed to an integrated process for improving the lubricating oil properties of a waxy feed stock, the process comprising;

a. separating the waxy feedstock into at least a light fraction and a heavy fraction;

b. upgrading at least a portion of the heavy fraction to form a waxy heavy lube base oil having a viscosity index which is greater than that of the heavy fraction;

c. upgrading at least a portion of the light fraction to form a waxy light lube base oil having a viscosity index which is greater than that of the light fraction;

d. contacting the waxy heavy lube oil base in a first dewaxing zone with a catalyst containing an intermediate pore aluminosilicate zeolite under preselected process conditions suitable to selectively crack at least a portion of the waxes present in the waxy heavy lube base oil;

e. contacting the waxy light lube base oil in a second dewaxing zone with a catalyst containing a hydrogenation component and an intermediate pore silicoaluminophosphate molecular sieve under preselected process conditions suitable to isomerize at least a portion of the waxes present in the waxy light lube base oil; and f. recovering a catalytically dewaxed heavy lube base oil product and a catalytically dewaxed light lube base oil product from the first and second dewaxing zones, respectively, each of said products having improved lubricating oil properties.

In the present process, a waxy feedstock is separated into at least a light and a heavy fraction. The light and heavy fractions are individually upgraded in turn such that a waxy lube base oil product from the upgrading step has a viscosity index (VI) which is higher than the feed to the upgrading step. The waxy lube base oil products are then individually dewaxed to a preselected pour point and cloud point, the pour point and the cloud point of the dewaxed product being at a temperature lower than those properties of the waxy products before dewaxing. A typical waxy feedstock to the process includes whole crudes, reduced crudes, vacuum tower distillates, atmospheric tower residua, cycle oils, gas oils, vacuum gas oils, synthetic crudes (e.g., shale oils, tar sand oil, etc.) and other heavy oils.

The present invention is particularly advantageous when the heavy lube base oil contains a relatively higher level of sulfur or nitrogen or of both sulfur and nitrogen relative to the light lube base oil. Therefore, it is an object of this invention to provide an integrated process for improving the lubricating oil properties of a waxy feedstock, including dewaxing a light lube base oil and a heavy lube oil base oil derived from the waxy feedstock, the heavy lube base oil being characterized by a relatively higher concentration of sulfur and/or nitrogen than the light lube base oil.

It is a further object of this invention to provide an improved catalytic dewaxing process that maximizes yields of both heavy and light lube oil products while significantly improving their lubricating oil properties. Two lubricating oil properties of concern when upgrading lube oil feed stocks are viscosity index, abbreviated VI, and pour point. When compared with dewaxing by isomerization, conventional catalytic dewaxing using a wax cracking catalyst to dewax a light lube base oil generally produces a low yield and a large VI penalty, i.e. the loss of VI of the product as compared to the VI of the feed stock. On the other hand, conventional catalytic dewaxing generally gives a high yield and a low VI penalty when processing heavy lube oil feed stocks. Isomerization typically produces the highest yield and a low VI penalty when the feed stock is a light lube base oil. In the present invention the lighter feed stocks are dewaxed using an isomerization catalyst and the heavier feed stocks are dewaxed using a conventional wax cracking catalyst. Therefore, using the present invention, total lube yield and product VI's are both improved relative to using a single catalytic dewaxing process to dewax the entire waxy feedstock. Further, by dewaxing the heavier oils with high nitrogen and sulfur levels using the conventional dewaxing catalyst, which is more tolerant of these contaminants, the light feeds may be dewaxed with an isomerization catalyst which is not subjected to the high nitrogen and sulfur levels encountered when dewaxing the heavy feed, and isomerization catalyst life is improved. Thus, the present invention would be expected to produce lower fouling rates and allow for the use of smaller size reactors.

The present invention is particularly advantageous when used to treat waxy feedstocks which are upgraded using a solvent refining operation.

In solvent refining the aromatic hydrocarbons are extracted from the feedstock using a solvent. Typically the heavy lube base oil feed stock prepared from a solvent refining operation contains sufficiently high concentrations of sulfur and/or nitrogen to unfavorably affect the performance of a catalyst containing an intermediate pore SAPO as an active component.

The waxy lube base oils will normally be a $C_{10}$+ feedstock generally boiling above about 350° F. (177° C.), since lighter oils will usually be free of significant quantities of waxy components. As used in this application the term heavy lube base oil refers to a lube base oil in which at least 80% of the components of the base oil have a boiling point above 900° F. As used herein, heavy lube base oil includes both heavy neutral and bright stock. The term light lube base oil refers to a lube base oil in which 80% or more of the components of the base oil have a boiling point below 900° F. Examples of light lube base oil include light neutral and medium neutral.

In practicing the invention the heavy lube base oil feed stock and the light lube base oil feed stock may be fed continuously into the process or the feed stocks may be processed in block operation.

BRIEF DESCRIPTION OF THE DRAWINGS

The Figure is a schematic flow diagram representing one embodiment of the invention.

DETAILED DESCRIPTION OF THE INVENTION

Figure 1:
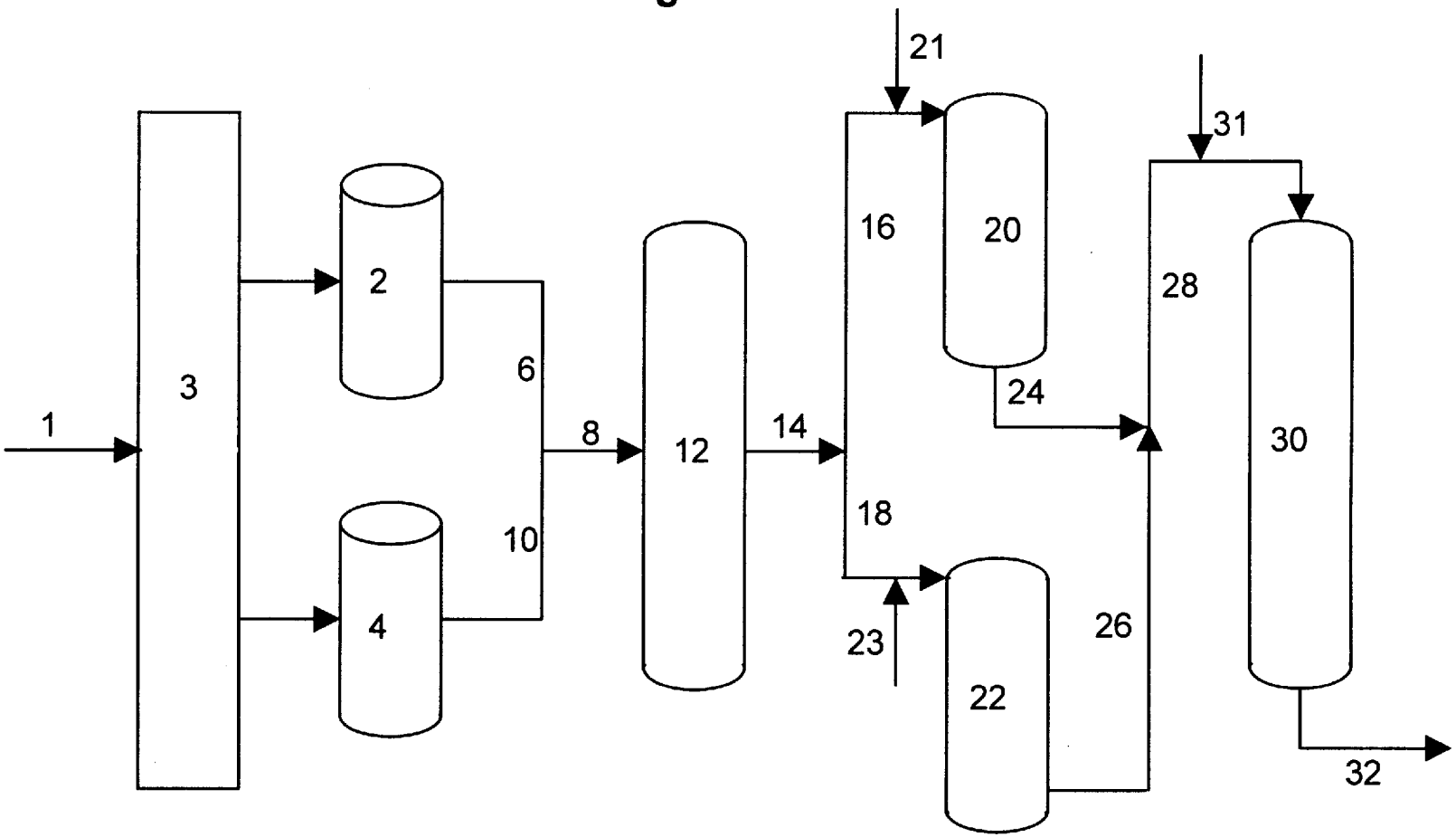

The process that is the subject of the present invention is an integrated process. As used herein the term "integrated process" refers to a process comprising a sequence of steps, some of which may be parallel to other steps in the process, but which are interrelated or somehow dependent upon either earlier or later steps in the total process.

The present process will be readily understood by referring to the flow diagram in the figure. In the flow scheme contained in the figure the process of the present invention is practiced by separating the waxy feedstock 1 in distillation column 3 and then upgrading the distilled fractions in block operation, i.e., the heavy and light feed stocks are processed alternately. However, it is possible to practice the present invention in continuous operation. In this instance two separate trains operating in parallel would be used, one train for the heavy feed stock and one train for the light feed stock.

In the embodiment of the invention shown in the figure, waxy heavy charge stock is stored in storage tank 4 until needed for processing. When it is ready for processing, the waxy heavy charge stock is withdrawn from storage tank 4 via conduits 10 and 8 and sent to the solvent refining unit 12. During processing of the heavy charge stock the waxy light charge stock is held in storage tank 2 until it is needed. In the solvent refining unit 12 the waxy heavy charge stock is extracted with a solvent, such as 1-methyl-2-pyrrolidinone, which is selective for aromatic hydrocarbons. The heavy solvent refined raffinate, which contains wax, is recovered from the solvent refining unit by conduit 14 and passes to the heavy lube oil dewaxing unit 22 via conduit 18. In the heavy lube oil dewaxing unit the heavy raffinate is contacted with the dewaxing catalyst which is preferably an intermediate pore aluminosilicate zeolite, such as ZSM-5, in the presence of hydrogen that is introduced into the dewaxing unit by conduit 23, under conditions selected to crack the waxes in the raffinate. The dewaxed heavy raffinate is recovered from the heavy lube oil dewaxing unit by outlet conduit 26 and passes to the hydrofinishing unit 30 by means of conduit 28. In the hydrofinishing unit the raffinate is contacted with hydrofinishing catalyst in the presence of hydrogen introduced via hydrogen inlet 31 to improve its stability, i.e., the raffinates oxidation stability and stability against the formation of sludge during storage. The hydrofinished heavy lube base oil is recovered from the hydrofinisher via conduit 32 and passes to storage or further processing.

In the case of the waxy light charge stock held in storage tank 2, the process is similar to that described above relative to the waxy heavy charge stock. Following processing of the heavy charge stock, the waxy light charge stock is withdrawn from storage tank 2 via lines 6 and 8 and sent to the solvent refining unit 12. The light solvent refined raffinate is recovered by line 14 and sent via conduit 16 to the light lube oil dewaxing unit 20 where it is contacted with an isomerization catalyst, such as an intermediate pore SAPO having a hydrogenation component, in the presence of hydrogen introduced via line 21, under conditions preselected to isomerize the waxes in the raffinate. The dewaxed light raffinate is recovered by conduit 24 from the light lube oil dewaxing unit and sent via line 28 to the hydrofinishing unit 30 where the dewaxed light raffinate is treated in a manner similar to the description above for the heavy raffinate. Again the hydrofinished light lube base oil is recovered via line 32 and passes to further processing or to storage until needed.

In one preferred embodiment, a hydrotreating unit may be interposed in the process scheme on line 14 between the solvent refining unit 12 and the dewaxing units 20 and 22. In another scheme, the hydrotreater could be placed before the solvent refining unit 12 on line 8.

As used in this specification, the terms hydrotreating and hydrocracking are given their conventional meaning and describe processes that are well known to those skilled in the art. Hydrotreating refers to a catalytic process, usually carried out in the presence of free hydrogen, in which the primary purpose is the desulfurization and/or denitrification of the feed stock. Generally, in hydrotreating operations cracking of the hydrocarbon molecules, i.e., breaking the larger hydrocarbon molecules into smaller hydrocarbon molecules, is minimized and the unsaturated hydrocarbons are either fully or partially hydrogenated in addition to removing nitrogen and sulfur from the waxy lube base oils. Another advantage of hydrotreating the waxy raffinates prior to dewaxing in the present invention is the saturation of the aromatic hydrocarbons present, which further improves VI.

Hydrocracking refers to a catalytic process, usually carried out in the presence of free hydrogen, in which the cracking of the low VI molecules is a primary purpose of the operation. Desulfurization and/or denitrification of the feed stock usually will also occur.

Catalysts used in carrying out hydrotreating and hydrocracking operations are well known in the art, and it should not be necessary to describe them in detail here. See for example U.S. Pat. Nos. 4,347,121 and 4,810,357 for general descriptions of hydrotreating, hydrocracking, and typical catalysts used in each process.

In the process of the present invention, the waxy feedstock is separated into at least a light fraction and a heavy fraction, such as by distillation. Distillation processes useful in the present process are well known in the art, and it should not be necessary to describe them in detail here. The terms "light fraction" and "heavy fraction" represent distillate fractions of the waxy feedstock distinguished by boiling point, the light fraction having a boiling range within a lower temperature range than that of the heavy fraction. It will be immediately obvious to those skilled in the art that, in general, other physical properties, such as density, sulfur content and nitrogen content will also distinguish the light fraction from the heavy fraction. Indeed, it is these additional distinguishing features which provides the surprising result of this invention, namely that dewaxing yields are maximized when the light fraction is dewaxed under isomerization conditions with a wax isomerization catalyst and the heavy fraction is dewaxed under cracking conditions with a wax cracking catalyst.

The boiling ranges of the light fraction and the heavy fraction may vary widely, depending on the type of waxy feedstock being processed and on the processing requirements. However, for the production of lube base oils, the light fraction will generally have at least 80% of the components of the light fraction having a boiling point below 900° F. (482° C.). Preferably, the light fraction will have a nominal boiling range between about 550° F. (288° C.) and 900° F. (482° C.). The heavy fraction will have at least 80% of the components of the heavy fraction having a boiling point above 900° F. (482° C.). Preferably, the heavy fraction will have a nominal boiling range between about 900° F. (482° C.) and 1150° F. (621° C.).

The light fraction is upgraded to produce a waxy light lube base oil, using a process such as hydrocracking or solvent extraction, such that the VI of the waxy light lube base oil is greater than that of the light fraction. The heavy fraction is also upgraded to produce a waxy heavy lube base oil, using a process such as hydrocracking or solvent extraction, such that the VI of the waxy heavy lube base oil is greater than that of the heavy fraction. Typically, the VI of the waxy lube base oils are above 85, preferably above 90.

The present invention is particularly advantageous when the lube feed stock is obtained from a solvent refining operation. In the typical solvent refining operation, the raw stock charge is extracted with a solvent which is selective for aromatic hydrocarbons. Suitable solvents employed in solvent refining operations include furfural, phenol, and chorex. Particularly preferred is the solvent 1-methyl-2-pyrrolidinone which is often abbreviated "NMP". Solvent refining processes useful for the present invention are well known (see for example U.S. Pat. No. 5,120,900), and do not require additional description. Vacuum residuum used as the heavy fraction usually will be deasphalted prior to solvent refining. The products recovered from the solvent refining unit are referred to as raffinates. The raffinates from the solvent refining operation are suitable for use as feed stocks in the catalytic dewaxing step of the present invention.

The impurities nitrogen and sulfur are usually significantly higher in the heavier raffinates, i.e., heavy neutral and bright stock, than in the lighter raffinates, i.e., light neutral and medium neutral. In one embodiment of the invention, the raffinates are hydrotreated prior to dewaxing to lower the nitrogen and sulfur content of the raffinates. A further benefit may involve saturation of the aromatics present. In some processing schemes, it may also be desirable to hydrotreat the feed stock prior to the solvent refining operation.

Typically, feed stocks employed in practicing the present invention are waxy feeds, i.e. a feed stock containing at least 10 percent wax. Waxy molecules are those molecules which produce high pour point and/or high cloud point when present in the lube base oil. One method for determining the amount of wax, as waxy molecules, present in a feed stock may be determined as follows:

A 300-g portion of sample feed stock is dissolved in 1200 ml of 1:1 toluene-methylethylketone (MEK) solvent. Heating may be necessary to achieve complete dissolution. The solution is then cooled overnight at −15° C. to −20° C. to crystallize the wax. The wax crystals formed are filtered and recovered. The filtrate is vacuum distilled to separate the toluene-MEK solvent from the dewaxed oil. Occluded solvent in the wax is removed by heating the wax on a hot plate with nitrogen blowing on the surface. The weights of the recovered oil and wax are divided by the weight of the original sample to obtain the percent oil and wax.

In the present invention the heavier raffinates are dewaxed using a conventional dewaxing catalyst, typically one containing an intermediate pore size aluminosilicate zeolite. Particularly preferred for dewaxing of the heavy raffinates are the zeolites ZSM-5 and ZSM-11. ZSM-5 is described in U.S. Pat. No. 3,702,886 and U.S. Pat. No. Re.29,948. ZSM-11 is described in U.S. Pat. No. 3,709,886. The relevant portions of these U.S. Patents are herein incorporated by reference. These aluminosilicate zeolites are particularly useful to dewax the heavy raffinates because they are relatively tolerant of the sulfur and nitrogen in the raffinates. The zeolite catalyst may be used without a metal component, but the presence of a metal hydrogenation component is usually preferred. The hydrogenation component usually consists of from about 0.05 to about 2 percent by weight of a metal, metal oxide, or metal sulfide from Group VIIIA of the Periodic Chart of the Elements. Group VIIIA of the Periodic Chart include platinum, palladium, iridium, ruthenium, cobalt, and nickel. In addition, metals or compounds of the metals from Group VIA of the Periodic Chart may be included in combination with the Group VIIIA metals. Group VIA metals include chromium, molybdenum, and tungsten. The hydrogenation component may consist of either a metal or metal compound alone or a mixture of two or more metals or metal compounds.

The hydrogenation components are added to the catalyst by methods well known to those skilled in the art, such as by impregnation or the like. The metals are typically added to the catalyst as a soluble compound by impregnation after which the impregnated catalyst is air dried and calcined.

The lighter raffinates are dewaxed in the present invention using an isomerization catalyst in association with a hydrogenation component. Isomerization catalysts useful in the present invention include non-zeolitic molecular sieves having intermediate size pores. Non-zeolitic molecular sieves are microporous compositions that are formed from $[AlO_2]$ and $[PO_2]$ tetrahedra and have electrovalently neutral frameworks. See U.S. Pat. No. 4,861,743.

Non-zeolitic molecular sieves include aluminophosphates ($AlPO_4$) as described in U.S. Pat. No. 4,310,440, silicoaluminophosphates (SAPO), metalloaluminophosphates (MeAPO), and nonmetal substituted aluminophosphates (EIAPO). Metalloaluminophosphate molecular sieves that may be useful as isomerization catalysts are described in U.S. Pat. Nos. 4,500,651; 4,567,029; 4,544,143; and 4,686,093. Nonmetal substituted aluminophosphates are described in U.S. Pat. No. 4,973,785. Preferably the isomerization catalyst will contain an intermediate pore silicoaluminophosphate or SAPO as the non-zeolitic molecular sieve component. Intermediate pore SAPO's which are particularly useful in carrying out the present invention include SAPO-11, SAPO-31, and SAPO-41. U.S. Pat. No. 4,440,871 describes SAPO's generally and SAPO-11, SAPO-31, and SAPO-41 specifically. The relevant parts of U.S. Pat. No. 4,440,871 relating to intermediate pore SAPO's are herein incorporated by reference.

The preferred intermediate pore isomerization silicoaluminophosphate molecular sieve present in the isomerization catalyst is SAPO-11. When combined with a hydrogenation component, SAPO-11 converts the waxy components to produce a lubricating oil having excellent yield, very low pour point, low cloud point, low viscosity and high viscosity index. As discussed above relative to zeolite catalysts, the hydrogenation component of the isomerization catalyst will be a Group VIIIA metal, metal compound or combination of Group VIIIA metals or metal compounds. Most preferably, the hydrogenation component will include either platinum or palladium or a combination of these metals or their compounds. The hydrogenation components are added to the catalyst by methods well known to those skilled in the art, such as by impregnation or the like. The metals are typically added to the catalyst as a soluble compound by impregnation after which the impregnated catalyst is air dried and calcined. The most preferred intermediate pore SAPO for use in the present invention is SM-3 which has a crystalline structure falling within that of the SAPO-11 molecular sieves. The preparation of SM-3 and its unique characteristics are described in U.S. Pat. No. 5,158,665 which is herein incorporated by reference.

The phrase intermediate pore size when referring to the zeolites or the SAPO's used in carrying out the present invention means an effective pore aperture in the range from about 5.3 to about 6.5 angstroms when the porous inorganic oxide is in the calcined form. Molecular sieves, including zeolites and SAPO's, in this range tend to have unique molecular sieving characteristics. Unlike small pore zeolites such as erionite and chabazite, they will allow hydrocarbons having some branching into the molecular sieve void spaces. Unlike larger pore zeolites such as faujasites and mordenites, they can differentiate between n-alkanes and slightly branched alkanes, and larger branched alkanes having, for example, quaternary carbon atoms.

The effective pore size of the molecular sieves can be measured using standard adsorption techniques and hydrocarbonaceous compounds of known minimum kinetic diameters. See Breck, *Zeolite Molecular Sieves*, 1974 (especially Chapter 8); Anderson, et al., J. Catalysis 58, 114 (1979); and U.S. Pat. No. 4,440,871, the pertinent portions of which are herein incorporated by reference.

In preparing catalysts for use in the present invention, the intermediate pore aluminosilicate zeolites and intermediate pore SAPO's may be used without additional forming, but usually the zeolite and SAPO's are composited with other materials resistant to the temperatures and other conditions employed in hydrocarbon conversion processes. Such matrix materials may include active and inactive materials and synthetic or naturally occurring zeolites as well as alumina, clays, silica, and metal oxides. The latter may occur naturally or may be in the form of gelatinous precipitates, sols, or gels, including mixtures of silica or alumina oxides. Use of other active materials in association with the intermediate pore zeolite or intermediate pore SAPO may be present to improve the conversion or selectivity of the catalyst in certain hydrocarbon conversion processes. Inactive materials can be used to serve as diluents in order to control the amount of conversion in a given process. Frequently binders, such as naturally occurring clays and inorganic oxides, may be present to improve the crush strength of the catalyst.

Naturally occurring clays which may be composited with the intermediate pore zeolite or intermediate pore SAPO in the catalyst include the montmorillonite and kaolin families which include the subbentonites and the kaolins commonly known as Dixie, McNamee, Georgia, and Florida clays or others in which the main mineral constituent is halloysite, kaolinite, dickite, nacite, auxite, and such. Such clays may be used in the raw state as originally mined or processed through calcination, acid treatment, or chemical modification. Other binders include inorganic oxides such as alumina and silica.

In addition to the foregoing materials, the intermediate pore zeolite or intermediate pore SAPO may be composited with a porous matrix material such as aluminum phosphate, silica-alumina, silica-magnesia, silica-zirconia, silica-thoria, silica-beryllia, silica-titania as well as tertiary compositions such as silica-alumina-thoria, silica-alumina-zirconia, silica-alumina-magnesia, and silica-magnesia-zirconia. The relative proportions of finely ground intermediate pore zeolite or intermediate pore SAPO to the matrix varies widely, generally the crystal will fall within the range of 1 to 90% by weight of the catalyst. The methods for preparing the catalyst compositions are well known to those skilled in the art and include such conventional techniques as spray drying, extrusion, and the like.

The dewaxing units are operated at conditions selected to optimize the performance of the catalyst. In general, this means maximizing the conversion of the waxy molecules while maintaining good yields. The dewaxing units usually will be operated at a catalyst temperature of from about 400° F. (204° C.) to about 900° F. (482° C.), preferably within the temperature range of from about 550° F. (288° C.) to about 750° F. 399° C.). The reactor pressure will usually be within the range of from about 50 to about 3000 psig (0.45–20.8 MPa), preferably within the range of from about 500 to about 2500 psig (3.55–17.3 MPa). The liquid hourly space velocity (LHSV) will usually fall within the range of from about 0.1 to about 5 $hr^{-1}$ (V/V), with a range of about 0.5 to 2 LHSV being preferred. The addition of hydrogen into the dewaxing units, while not essential, is preferred. When hydrogen is used it is generally added in the range of from about 500 to about 10,000 standard cubic feet per barrel of feed (SCF/B) (89.1–1780 std $m^3$ $H_2/m^3$ oil), preferably within the range of from about 1000 to about 5000 SCF/B (178–891 std $m^3$ $H_2/m^3$ oil). The residence times of the lube oil base stock in the dewaxing units will usually be selected to achieve the lubricating oil properties desired. Usually the residence time will be selected to achieve the target pour point of the lube base oil product. In general, the dewaxed heavy and light lube base oil products will have a pour point less than that of the waxy lube base oils from which they are made. Preferably, the pour point of the dewaxed lube base oils will be less than about 5° C., more preferably less than about 0° C., and still more preferably less than about −5° C.

As already mentioned one advantage of the present invention is that the light lube base oil recovered from a solvent refining operation will usually have reduced nitrogen and sulfur as compared to the heavy lube base oil. Sulfur in particular has been found to reduce the selectivity of the intermediate pore SAPO in isomerizing the waxes. The light lube base oil fraction will preferably have a nitrogen content of less than 100 ppm, preferably<50 ppm, most preferably<20 ppm. The sulfur content of the light lube base oil fraction should be below 500 ppm, preferably below 100 ppm and most preferably below 50 ppm. These levels of sulfur and nitrogen in the light lube base oil fraction are readily achieved in conventional solvent refining processes; therefore it is not necessary to include an extra step to achieve these levels when practicing this particular embodiment of the invention. Within the levels described above there should be minimal effect upon the activity of the intermediate pore SAPO selected for isomerizing the light lube base oil. As already noted, the presence of sulfur and nitrogen in the heavy lube base oil is of less concern since the activity of the intermediate pore aluminosilicate zeolite is less affected by the presence of these contaminants.

As discussed above, the lube base oils may be recovered from a hydrocracking operation prior to dewaxing instead of from a solvent dewaxing operation. However, the present invention is most advantageous when the lube base oil fractions are recovered from a solvent refining operation. In this instance, the dewaxed lube base oil products are usually hydrofinished to improve their stability and appearance. In general, the hydrofinishing operation is carried out within the same general ranges as the dewaxing operations, but preferably at a slightly lower temperature range of from about 400° F. (204° C.) to about 600° F. (31° C.). Hydrotreating catalysts suitable for use in this operation are well known in the art and need not be discussed in detail here. It should be sufficient to note that most hydrofinishing catalysts consist of a inorganic oxide support, commonly alumina or silica-alumina. One or more metals or metal compounds from Group VIIIA and Group VIA of the periodic Chart of the Elements is usually present on the support. In some schemes it may be preferable to hydrofinish the raffinates recovered from the solvent refining operation prior to dewaxing.

The following examples will help to further illustrate the invention but are not intended as a limitation to the scope of the process.

EXAMPLE 1

The West Texas medium raffinate feed stock having the inspections shown in Table I was dewaxed over a Pt/SAPO-11 catalyst at 0.5 LHSV, 1100 psig (7.68 MPa), and 8 MSCF/bbl $H_2$ (1430 std $m^3$ $H_2/m^3$ oil) to produce an oil with a pour point of −9° C. (Table II). The required catalyst temperature to achieve this pour point was 717° F. (381° C.).

TABLE I

| INSPECTIONS OF WEST TEXAS MEDIUM RAFFINATE | | |
|---|---|---|
| Gravity, API | 32.5 | |
| Nitrogen, ppm | 79 | |
| Sulfur, ppm | 1360 | |
| Viscosity, cSt, | | |
| 70° C. | 10.88 | |
| 100° C. | 5.376 | |
| Sim. Dist., LV % | °F. | °C. |
| ST/5 | 551/636 | 288/336 |
| 10/30 | 669/752 | 354/400 |
| 50 | 822 | 439 |
| 70/90 | 875/930 | 468/499 |
| 95/EP | 952/1000 | 511/538 |
| Solvent Dewaxed Oil | | |
| Yield, Wt % | 84.4 | |
| Pour Point, °C. | −12 | |
| Cloud Point, °C. | −9 | |
| Viscosity, cSt, | | |
| 40° C. | 39.17 | |
| 100° C. | 6.026 | |
| VI | 96 | |
| Sim. Dist., LV % | °F. | °C. |
| St/5 | 559/632 | 293/333 |
| 10/30 | 666/754 | 352/401 |
| 50 | 828 | 442 |
| 70/90 | 884/940 | 473/504 |
| 95/EP | 963/1012 | 517/544 |

EXAMPLE 2

The same feed stock as shown in Table I was dewaxed over a catalyst containing ZSM-5 at 0.5 $hr^{-1}$ LHSV, 1100 psig (7.68 MPa), and 8 MSCF/bbl $H_2$ (1430 std $m^3H_2/m^3$ oil) as in Example 1 above. As shown in Table II the yield and VI were lower than for the SAPO-11 catalyst of Example I. The required catalyst temperature to achieve a −9° C. pour point was only about 590° F. (310° C.).

Examples I and II illustrate the advantages of using an intermediate pore SAPO over an intermediate pore aluminosilicate zeolite to dewax a light lube base oil. In this instance the product yield and product VI were significantly higher with the SAPO-11.

EXAMPLE 3

The same Pt/SAPO-11 catalyst used in Example 1 was used to dewax the West Texas heavy raffinate having the inspections shown in Table III. This oil was produced in the same solvent extraction plant as the medium raffinate of Table 1. This oil which was higher in sulfur and nitrogen than the medium raffinate feed, could not be dewaxed at a temperature below 725° F. (385° C.) at the same run conditions as in Examples 1.

TABLE III

| INSPECTIONS OF WEST TEXAS HEAVY RAFFINATE | | |
|---|---|---|
| Gravity, °API | 30.1 | |
| Sulfur, ppm | 1570 | |
| Nitrogen, ppm | 99.3 | |
| Viscosity, | | |
| 70° C., cSt | 25.31 | |
| 100° C. cSt | 10.90 | |
| Sim. Dist., LV % | °F. | °C. |
| ST/5 | 116/833 | 47/445 |
| 10/30 | 866/924 | 463/496 |

TABLE II

DEWAXING WEST TEXAS MN RAFFINATE AT 0.5 LHSV, 1100 PSIG, AND 8 MSCF/BBL

| Catalyst | Pt/SAPO-11 | | ZSM-5 | | | |
|---|---|---|---|---|---|---|
| Temperature, °F. (°C.) | 717 (381) | | 587 (308) | | 595 (313) | |
| Pour Pt, °C. | −9 | | −7 | | −17 | |
| Cloud Pt, °C. | −6 | | −6 | | −14 | |
| Yield 650° F. (343° C.)+, Wt % | 86.5 | | 78.8 | | 75.9 | |
| Viscosity, | | | | | | |
| 40° C., cSt | 37.01 | | 46.26 | | 49.85 | |
| 100° C., cSt | 6.071 | | 6.583 | | 6.753 | |
| VI | 109 | | 91 | | 85 | |
| Lube Yield, LV % | 84.2 | | 74.4 | | 70.7 | |
| Sim. Dist, LV % | °F. | °C. | °F. | °C. | °F. | °C. |
| ST/5 | 621/692 | 327/367 | 121/657 | 49/347 | 120/662 | 49/350 |
| 10/30 | 718/788 | 381/420 | 688/780 | 364/416 | 691/780 | 366/416 |
| 50 | 840 | 449 | 844 | 451 | 843 | 451 |
| 70/90 | 885/938 | 474/503 | 891/944 | 477/507 | 891/942 | 477.506 |
| 95/99 | 961/1009 | 516/543 | 967/1016 | 519/547 | 965/1011 | 518/544 |

TABLE III-continued

| INSPECTIONS OF WEST TEXAS HEAVY RAFFINATE | | |
|---|---|---|
| 50 | 961 | 516 |
| 70/90 | 998/1052 | 537/567 |
| 95/EP | 1084/1145 | 584/618 |
| Solvent Dewaxed Oil | | |
| Yield, Wt % | 76.6 | |
| Pour Point, °C. | −15 | |
| Viscosity, | | |
| 40° C., cSt | 125.8 | |
| 100° C., cSt | 12.84 | |
| VI | 94 | |

EXAMPLE 4

The heavy raffinate of Table III is dewaxed over a catalyst that contains ZSM-5 using the same general process conditions. In this instance the oil can be dewaxed at a temperature below 700° F. (371° C.).

Examples 3 and 4 illustrate that the higher activity of ZSM-5 allows the heavy lube base oil to be dewaxed at a lower temperature than SAPO-11. This advantage will translate into longer run life for ZSM-5 when treating heavy oils.

It will be apparent to those skilled in the art that the specific embodiments discussed above can be performed successfully using components or ingredients equivalent to those generically or specifically set forth above. In addition, the specific process conditions under which the operations may be successfully carried out may vary somewhat depending on circumstances well known to those skilled in the art.

I claim:

1. An integrated process for improving the lubricating oil properties of a waxy feedstock comprising:

a. separating the waxy feedstock into at least a light fraction and a heavy fraction;

b. upgrading at least a portion of the heavy fraction to form a waxy heavy lube base oil having a viscosity index which is greater than that of the heavy fraction;

c. upgrading at least a portion of the light fraction to form a waxy light lube base oil having a viscosity index which is greater than that of the light fraction;

d. cracking at least a portion of the waxes present in the waxy heavy lube base oil in a first dewaxing zone in the presence of a wax cracking catalyst under process conditions preselected to crack said waxes;

e. isomerizing at least a portion of the waxes present in the waxy light lube base oil in a second dewaxing zone in the presence of a medium pore size non-zeolitic molecular sieve containing catalyst under process conditions preselected to isomerize said waxes; and f. recovering a catalytically dewaxed heavy lube base oil product and a catalytically dewaxed light lube base oil product from the first and second dewaxing zones, respectively, each of said products having improved lubricating oil properties.

2. The process of claim 1 wherein the isomerizing catalyst is a non-zeolitic molecular sieve.

3. An integrated process for improving the lubricating oil properties of a waxy feedstock comprising:

a. separating the waxy feedstock into at least a light fraction and a heavy fraction;

b. upgrading at least a portion of the heavy fraction to form a waxy heavy lube base oil having a viscosity index which is greater than that of the heavy fraction;

c. upgrading at least a portion of the light fraction to form a waxy light lube base oil having a viscosity index which is greater than that of the light fraction;

d. contacting the waxy heavy lube base oil in a first dewaxing zone with a catalyst containing an intermediate pore aluminosilicate zeolite under preselected process conditions suitable to selectively crack at least a portion of the waxes present in the waxy heavy lube base oil;

e. contacting the waxy light lube base oil in a second dewaxing zone with a catalyst containing a hydrogenation component and an intermediate pore silicoaluminophosphate molecular sieve under preselected process conditions suitable to isomerize at least a portion of the waxes present in the waxy light lube base oil; and f. recovering a catalytically dewaxed heavy lube base oil product and a catalytically dewaxed light lube base oil product from the first and second dewaxing zones, respectively, each of said products having improved lubricating oil properties.

4. The process of claim 3 wherein the intermediate pore silicoaluminophosphate molecular sieve in the catalyst of the second dewaxing zone is selected from the group consisting of SAPO-11, SAPO-31 and SAPO-41.

5. The process of claim 4 wherein the intermediate pore silicoaluminophosphate molecular sieve is SAPO-11.

6. The process of claim 5 wherein the intermediate pore silicoaluminophosphate molecular sieve second dewaxing zone is SM-3.

7. The process of claim 3 wherein the intermediate pore aluminosilicate zeolite in the catalyst of the first dewaxing zone is selected from the group consisting of ZSM-5 and ZSM-11.

8. The process of claim 7 wherein the intermediate pore aluminosilicate zeolite is ZSM-5.

9. The process of claim 3 wherein the catalyst of the first dewaxing zone contains a hydrogenation component.

10. The process of claim 9 wherein the hydrogenation component contains a metal or a compound of a metal from Group VIIIA of the Periodic Chart of the Elements.

11. The process of claim 3 wherein the waxy heavy lube base oil is a raffinate recovered from a solvent refining unit.

12. The process of claim 3 wherein the waxy light lube base oil is a raffinate recovered from a solvent refining unit.

13. The process of claim 11 wherein the raffinate is hydrotreated prior to dewaxing.

14. The process of claim 12 wherein the raffinate is hydrotreated prior to dewaxing.

15. The process of claim 3 wherein the waxy light lube base oil contains significantly lower amounts of sulfur than the waxy heavy lube oil.

16. The process of claim 3 wherein the waxy light lube base oil contains significantly lower amounts of nitrogen than the waxy heavy lube oil.

17. The process of claim 15 wherein the amount of sulfur in the waxy light lube base oil is less than 500 ppm.

18. The process of claim 3 including the additional step of hydrofinishing the catalytically dewaxed lube base oil products.

19. An integrated process for improving the lubricating oil properties of a waxy feedstock comprising:

a. separating the waxy feedstock into at least a light fraction and a heavy fraction;

b. solvent refining the light fraction and the heavy fraction using a solvent selected to remove aromatic components from said fractions;

c. recovering separately a waxy heavy lube base oil raffinate and a waxy light lube base oil raffinate, the waxy light lube oil raffinate having a sulfur content of less than 100 ppm and a nitrogen content of less than 100 ppm;

d. contacting the waxy heavy lube base oil raffinate in a first dewaxing zone in the presence of hydrogen with a catalyst containing a hydrogenation component and an intermediate pore aluminosilicate zeolite at a temperature of from about 550° to about 750° F., at a pressure between about 500 to about 2500 psig, and at a liquid hourly space velocity between about 0.5 and 2 for a time sufficient to crack a significant amount of the waxes present;

e. contacting the waxy light lube base oil raffinate in a second dewaxing zone in the presence of hydrogen with a catalyst containing a hydrogenation component and an intermediate pore silicoaluminophosphate molecular sieve at a temperature of from about 550° to about 750° F., at a pressure between about 500 to about 2500 psig, and at a liquid hourly space velocity between about 0.5 and 2 for a time sufficient to isomerize a significant amount of the waxes present; and f. recovering from the first and second dewaxing zones a heavy lube base oil product and a light lube base oil product, respectively, each product having improved lubricating oil properties as compared to the corresponding lube base oil fraction.

20. The process of claim 19 wherein the waxy heavy lube base oil and the waxy light lube base oil are hydrotreated prior to the solvent refining step.

21. The process of claim 19 including the additional step of hydrotreating the recovered waxy heavy lube base oil raffinate and the recovered waxy light lube base oil raffinate prior to contacting said raffinates in the first and second dewaxing zones with the intermediate pore aluminosilicate zeolite and the intermediate pore silicoaluminophosphate molecular sieve, respectively.

22. The process of claim 19 including the additional step of hydrofinishing the catalytically dewaxed lube base oil products.

* * * * *